US005313380A

United States Patent [19]

Weigert

[11] Patent Number: 5,313,380

[45] Date of Patent: May 17, 1994

[54] LIGHTING ASSEMBLY

[75] Inventor: Dedo A. Weigert, München, Fed. Rep. of Germany

[73] Assignee: Dedo Weigert Film GmbH, Munich, Fed. Rep. of Germany

[21] Appl. No.: 56,388

[22] Filed: May 4, 1993

[30] Foreign Application Priority Data

May 11, 1992 [DE] Fed. Rep. of Germany ..... 4215382

[51] Int. Cl.[5] ..... F21V 17/02

[52] U.S. Cl. ..... 362/325; 362/279; 362/342; 362/354

[58] Field of Search ..... 362/325, 319, 321, 322, 362/323, 324, 279, 290, 342, 354

[56] References Cited

U.S. PATENT DOCUMENTS 3,751,658 8/1973 Arnold ..... 362/354

FOREIGN PATENT DOCUMENTS 1973409 4/1967 Fed. Rep. of Germany .

766967 7/1934 France ..... 362/354

*Primary Examiner*—James C. Yeung

*Attorney, Agent, or Firm*—Griffin, Butler, Whisenhunt & Kurtossy

[57] ABSTRACT

A lighting assembly has a grid (5) arranged to be adjustable at a light outlet of a housing (1). In one embodiment, there is a plurality of grids (4, 5, 6), preferably arranged one behind the other in a direction of light rays, which are movable relative to one another. When the position of a grid (5) of such a lamp assembly is adjusted, a light emission angle of the lighting assembly is adjusted. When, in a preferred embodiment, slats of the grids are arranged in true alignment to one another, a light emission angle is relatively small. By adjusting the grids, for example by one half step adjustments relative to one another, the light emissions angle is enlarged accordingly. Thus, a directional effect can be achieved without a focussing effect, even with the use of fluorescent tubes.

7 Claims, 2 Drawing Sheets

LIGHTING ASSEMBLY

BACKGROUND OF THE INVENTION

Light sources for film and television lighting come in several different categories.

Open-face lamp assemblies are characterized by having light sources and reflectors. If a distance between such a light source and a reflector can be varied, the light therefrom can be focussed. Open-face lamp assemblies are not always really "open", often light outlet openings thereof are covered by light-transmissive shields. In some instances, light-diffusing foils are mounted at varying distances for increasing an illumination, radiation, or reflecting, angle and enlarging an illuminated area.

Directly-radiating open-face lamp assemblies usually do not produce good quality light. Blinds, or shutters, used with such lamp assemblies often cause double shadows, a focus area thereof is small and light quality thereof does not necessarily meet high standards. Directly lighting an object with open-face lamp assemblies creates hard shadows.

Indirectly-radiating open-face lamp assemblies, which include lighting pans, or bowls, have light sources which do not emit light directly towards objects. Light is emitted towards reflectors which, in turn, reflect it towards the objects. Thus, illuminated areas are enlarged and shadows become softer. Such lamp assemblies cannot be focussed.

A projecting lamp assembly normally comprises a light source and a reflector which can be moved together. A lens (almost always a step lens) is immovably mounted. Such lamp assemblies can be focussed. Their light is of better quality than that of open-face lamp assemblies. Blinds, gates, or shutters, do not cause double shadows typical for some open-face lamp assemblies.

All lamp assemblies which emit light directly (that is, without light diffusers) cast hard shadows; particularly in small rooms the use of several such lamp assemblies causes multiple shadows (the calling card of a bad cameraman).

An attempt to enlarge an illuminated, or reflecting, area by mounting diffusing material in a frame in front of such a lamp assembly results in loss of control by the lamp assembly itself of the illumination, or radiation, angle, because this is then determined by the diffusing materials. Thus, portions of the object are often lighted which actually should not be lighted. Therefore, black shutters are mounted on upper, left, right and bottom sides in front of such a diffuser frame for again limiting the radiation angles of the light. Such an arrangement (for a single light source) works only with a stand for the lamp assembly, another for the diffuser frame and four more for the black shutters, or blinds. This might possibly work in a studio, but at original film sites where, nowadays, many television series are filmed, this takes up a lot of space, is cumbersome and requires too much time. Therefore, it would be beneficial for many lighting arrangements if an illuminated area could be enlarged without enormous construction and multiple stands (thus saving space), while, at the same time, control of the illumination angle is maintained.

It is important to be able to control the illumination angle when working with "spotlights", that is, light that falls onto an object from the direction of the camera. Controlling the illumination angle is important, because in this manner one can prevent portions of the set which are not to be illuminated from this direction from being illuminated (thus allowing also for control of shadows). Even more important is the ability to control a light outlet when light is used behind an actor (as a highlight, such as side lighting coming from behind and the side). This direction of light is particularly important for a one-eyed film and television camera for "setting off", or distinguishing, an actor from his background. When using such light sources, of course, no light should fall directly onto the camera, thus, limiting the outlet angle is particularly important. When using conventional lamp assemblies (open-face projecting lamp assemblies or step-lens projecting lamp assemblies) for this purpose, light outlets are easily controllable by blinds mounted on the lamp assembly, possibly also by viewing hoods. However, the reflecting area remains small and the shadows are hard.

Many television series today are filmed on site with main light sources of a room being used as well. These may be fluorescent tubes on office ceilings or large window areas. Particularly in such rooms, it is not desirable to use lamp assemblies with small illuminated areas, because with such lighting arrangements hard shadows appear to be unnatural. Nevertheless, the light must be structured, or controlled.

In the near future, light sources with fluorescent tubes will substantially gain in significance for such lighting arrangements.

To date, all light sources with fluorescent tubes have been large and cumbersome. In addition, their light intensities have not been high enough to allow for noticeable lighting effects at greater distances.

New technologies concerning fluorescent tubes, such as folded coupled tubes, now allow, in connection with high-frequency operation of these tubes, one to fabricate smaller lamp assemblies with fluorescent tubes and to increase their light output so as to cover greater distances.

At the same time, light sensitivity of video cameras and films has increased. All of these factors allow one to work with substantially less light than before. All of these factors favor the use of lamp assemblies with fluorescent tubes.

Since fluorescent tubes use substantially less energy than other light sources, sufficient lighting can be provided in rooms with regular power outlets without requiring special electrical provisions. In addition, light of fluorescent tubes is cooler (more lumen per Watt).

Lamp assemblies having fluorescent tubes cannot be focussed. In this regard, optical provisions cannot be used for directing their light, because light sources thereof are not pin-pointed. Reflectors can increase light efficiency, but they cannot have a significant effect because of the given, very wide illumination angles of these lamp assemblies. Grids are sometimes mounted at the fronts of these lamp assemblies to somewhat influence the direction of the light from their light sources. Many office lamp assemblies have such light grids. In offices working with monitor screens, the grids are mounted relatively low and slats of the grids are spaced closer together to decrease an illumination angle. Such a grid is mounted higher with slats thereof being spaced wider apart for enlarging the illumination, or reflecting, angle.

It is an object of this invention to provide a lighting assembly which allows alteration of an illumination angle in an uncomplicated manner, even when fluorescent tubes are used.

SUMMARY

According to principles of this invention, a grid, or lattice, of a lighting assembly is generally movable. In one embodiment, the grid is arranged to be movable in the direction of light rays. Thus, the light outlet angle is larger or smaller depending upon the grid's spacing from the light source a greater or shorter distance. However, this solution requires a relatively elongated construction.

Thus, in a preferred embodiment, at least two grids are arranged at a light outlet of a lighting assembly, one behind the other in a direction of light rays, to be movable perpendicular to the direction of light rays and relative to one another.

In the preferred embodiment, three grids are arranged, at a light outlet opening of a light source housing, one behind the other in a direction of light rays, the first and the third grids being immovably mounted to the light source housing and the second grid being movably mounted between the first and third grids.

BRIEF DESCRIPTION OF THE DRAWINGS

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF A PREFERRED EMBODIMENT

Figure 1:
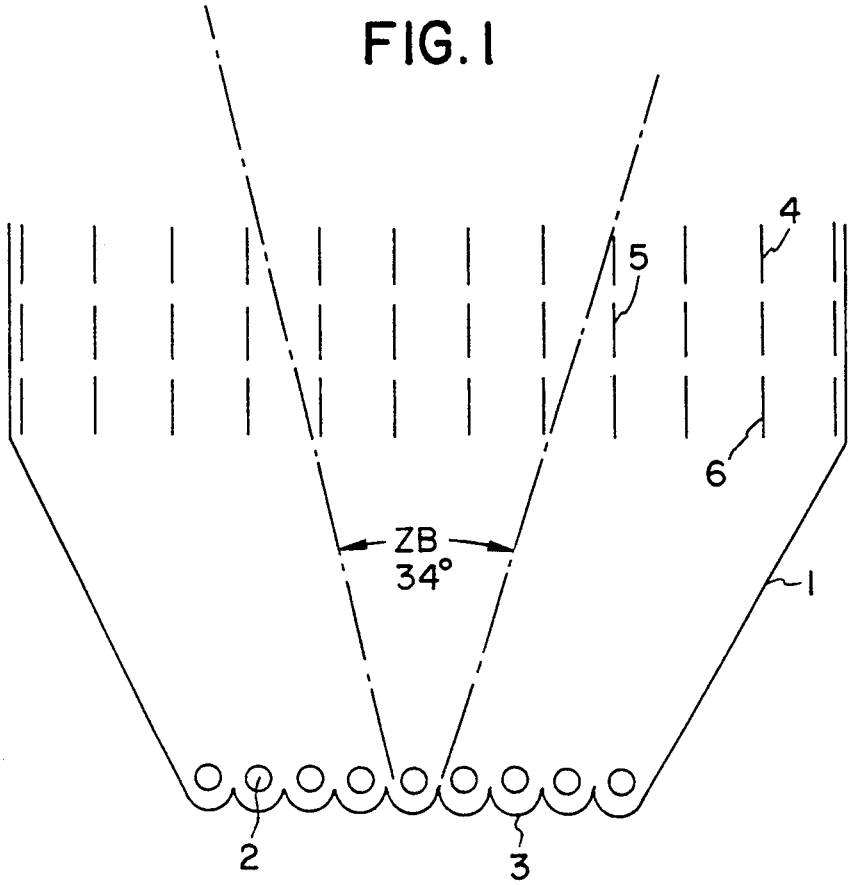
FIG. 1 is a simplified, or schematic, segmental, cross-sectional side view of a light source housing of this invention with three grids arranged one in front of the other (in a direction of outwardly travelling light) in true alignment with one another.

FIG. 1 shows a lighting assembly having a light source housing 1 with several fluorescent light tubes 2 arranged therein. The light source housing 1 has a reflector 3 mounted at a floor, or base, thereof behind the fluorescent light tubes 2. The light source housing 1 is comprised of an outwardly widening bottom portion, and an upper, or outer, portion having parallel sidewalls, which define a light outlet opening. End walls of the housing are not shown in the drawings for the sake of simplicity. Three grids, or lattices, (shown schematically as three groups of parallel adjacent lines (slats) in the drawings) 4, 5 and 6 are located in the light outlet opening, the first grid 4 and the third grid 6 being formed of immovable members mounted on the light source housing 1, while the second grid 5 is movable relative to the first and third grids as indicated by a two-headed arrow 7 which also represents a device for moving, or allowing movement of, the grid 5.

If the slats of the three grids 4, 5 and 6 are arranged to be in true alignment to one another, as shown in FIG. 1 the illumination angles, shown in dot-dash lines, are relatively small. Thus, the light has a certain directional effect, although it cannot be focussed.

Figure 2:
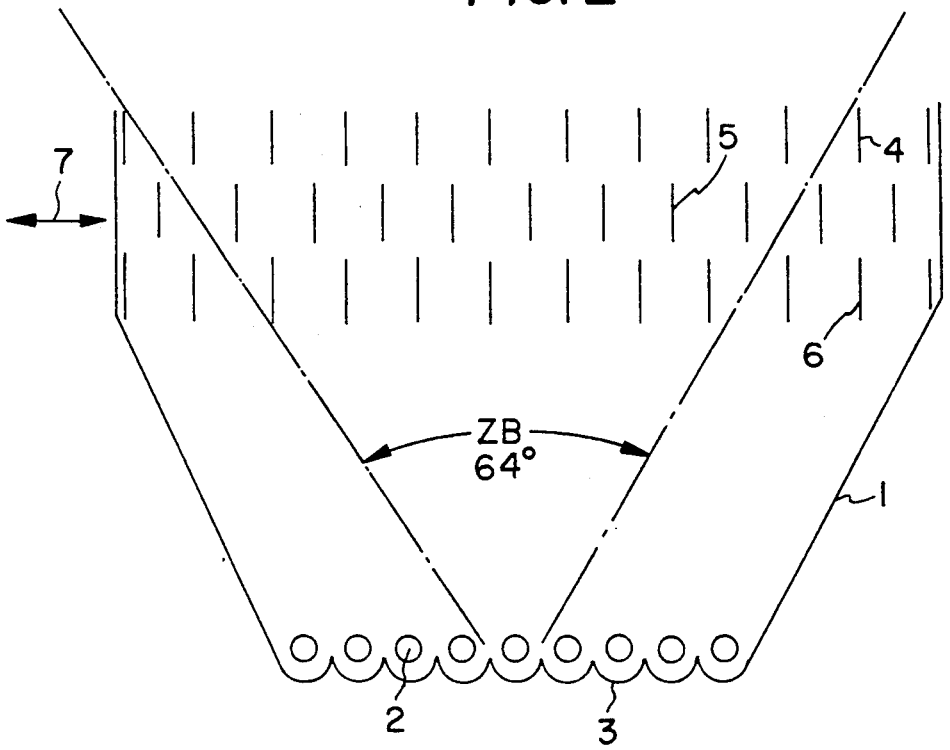
FIG. 2 is a similar cross-sectional side view of the light source housing of FIG. 1 after the second grid has been adjusted by one half grid space.

When one of the three grids 4, 5, 6, in the preferred embodiment the second grid 5, is moved perpendicular to a light ray channel, or direction, the illumination angles of the lighting assembly widen, as indicated by dot-dash lines in FIG. 2, into wider illumination, or reflecting, angles, thus allowing a more general lighting of an object.

Figure 3:
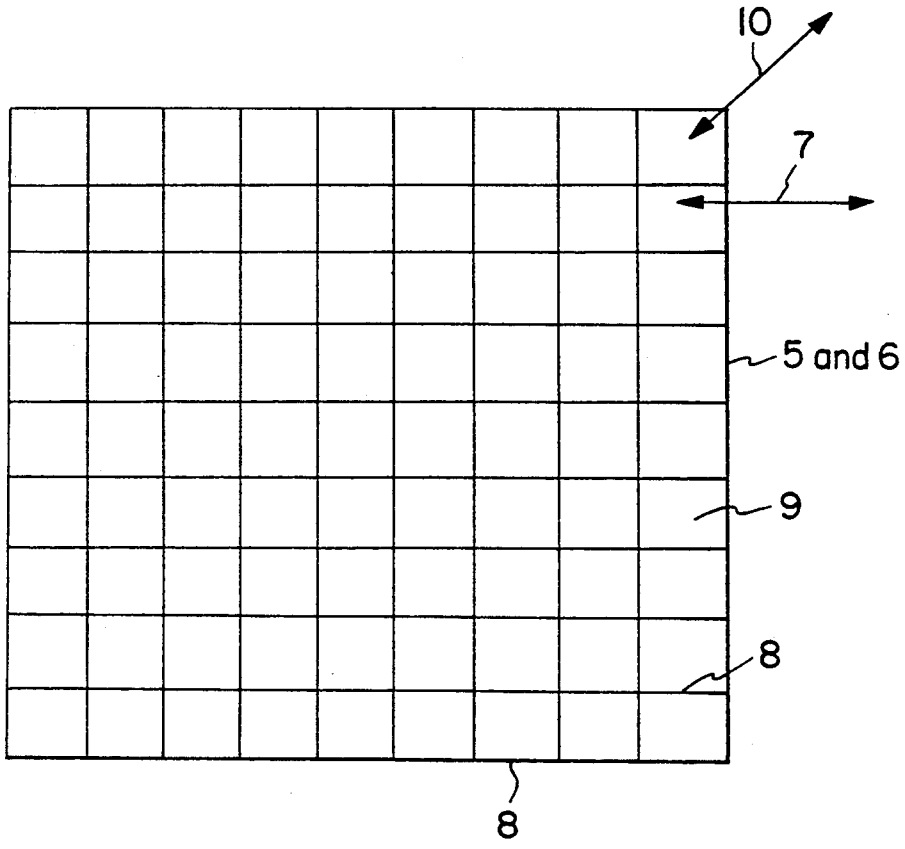
FIG. 3 is a simplified, or schematic, front view of one of the grids in an embodiment of the invention in which it has crossed members, or slats.

The lighting assembly of this invention allows for controlling, or limiting, light passing through an outlet without adding large structures. If the grid 6, for example, comprises crossed members, or slats, 8 so as to define rectangular spaces 9 therebetween and the second grid 5 of the preferred embodiment has similar construction and is adjusted, or moved, diagonally (see arrow 10 in FIG. 3), but laterally to light rays, by one half of a grid space, illumination angles are widened in all directions. If the second grid is moved sideways only (see arrow 7 in FIGS. 2 and 3), the illumination angle remains identically restricted in one direction (for example, the direction perpendicular to the paper in FIGS. 1 and 2), while being widened in the other direction (as shown by the dot-dash lines in FIGS. 1 and 2). If the second grid is moved towards the direction perpendicular to the paper in FIGS. 1 and 2 without altering the side direction indicated by arrow 7, the illuminated area is widened in the direction perpendicular to the paper, while it remains unchanged in the side direction.

The two latter beneficial choices for variations allow for changing the shape of the reflected light with respect to length and/or width. The thusly achieved effect corresponds to that achieved by large flaps, or blinds, but without the necessary effort and expense therefor.

It is also beneficial that the lighting assembly of this invention has a large reflection area, casts soft shadows and gives off cool light when using fluorescent light tubes. Energy consumption is relatively small.

In the lighting assembly of this invention, practically any types of light sources can be used, for example, localized, or point, light sources such as light bulbs, single fluorescent light tubes, or surface lamp assemblies comprised of several fluorescent light tubes arranged next to one another.

Basically, when in the preferred embodiment the slats of two grids are adjacently arranged to cover the same opening area, a total achieved depth of the grids amounts to that of both grids together. By moving one grid relative to the other, the effective grid depth can be reduced to that of the grid closest to the light source. Thus, the reflection angle of the lighting assembly can be increased accordingly.

While the invention has been particularly shown and described with reference to a preferred embodiment, it will be understood by those of ordinary skill in the art that various changes in form and detail may be made therein without departing from the spirit and scope of the invention.

For example, the grids may be arranged to be movable in all directions relative to one another, thus allowing the illumination angle to be limited or enlarged in all directions. When using, for example, crossed grids which define rectangular or square grid spaces, the grids can be movable not only perpendicular to the sidewalls of the grid spaces but also diagonally thereto.

The embodiments of the invention in which an exclusive property or privilege are claimed are defined as follows:

1. A lightning assembly to be used generally for scene illumination, said assembly comprising:

a housing defining a light outlet opening;

a generally broad light-source means arranged in said housing for producing substantially unfocused light from an area extending laterally to light travelling from said light source through said light outlet opening; and grids arranged at said light outlet opening for affecting light from said light source passing through said light opening, said grids being formed of slats with relatively wide width dimensions thereof extending approximately in the direction of light passing through said light opening and relatively thin thickness dimensions thereof facing light travelling from said light source through said light outlet opening;

wherein said lighting assembly further includes an adjusting means coupled to at least one of said grids for allowing adjustment of the position of said at least one grid; and wherein there are at least two grids arranged in the light outlet opening one behind the other in the direction of light rays passing through the outlet opening, said adjusting means allowing relative adjustment of the positions of the grids to one another lateral to the direction of light rays passing through the outlet opening for thereby changing an area being illuminated by said lighting assembly.

2. A lighting assembly as in claim 1 wherein grid spaces of at least one of said grids are rectangular in a cross-sectional profile and wherein said grid spaces are adjustably movable along a directional component laterally to the direction of light rays passing through the outlet opening.

3. A lighting assembly as in claim 2 wherein there are three grids with the second grid being adjustable and the first and third grids being immovably mounted to the housing.

4. A lighting assembly as in claim 1 wherein there are three grids with the second grid being adjustable and the first and third grids being immovably mounted to the housing.

5. A lighting assembly as in claim 1 wherein said generally broad light-source means comprises a plurality of adjacent light-producing tubes.

6. A lighting assembly as in claim 5 wherein said light-producing tubes are fluorescent light tubes.

7. A lighting assembly as in claim 5 wherein there are three grids with the second grid being adjustable and the first and third grids being immovably mounted to the housing.

* * * * *